US005225802A

United States Patent [19]

Dudley et al.

[11] Patent Number: 5,225,802

[45] Date of Patent: * Jul. 6, 1993

[54] LOW LOSS SPIDERS

[75] Inventors: Richard F. Dudley, Toronto; Patrick E. Burke, North York, both of Canada

[73] Assignee: Trench Electric, a division of Guthrie Canadian Investments Limited, Canada

[ * ] Notice: The portion of the term of this patent subsequent to Nov. 29, 2006 has been disclaimed.

[21] Appl. No.: 455,124

[22] Filed: Jan. 3, 1983

[30] Foreign Application Priority Data

Jan. 20, 1982 [CA] Canada ..... 394500

[51] Int. Cl.[5] ..... H01F 27/28

[52] U.S. Cl. ..... 336/180; 336/65; 336/207

[58] Field of Search ..... 174/129 R, 126 CP, 133 B; 191/22 DM, 33 PM, 22 CP; 336/180, 185, 192, 207

[56] References Cited

U.S. PATENT DOCUMENTS

| | | | |
|---|---|---|---|
| 588,541 | 8/1897 | Walkins | 191/22 DM |
| 1,101,579 | 6/1914 | Steinberger | 191/33 PM |
| 3,225,319 | 12/1965 | Trench | 336/180 |
| 3,382,329 | 5/1968 | Wilcox | 174/128 B X |
| 3,696,315 | 10/1972 | Riggins | 336/207 X |
| 3,902,147 | 8/1975 | Trench | 336/180 X |

FOREIGN PATENT DOCUMENTS

| | | | |
|---|---|---|---|
| 756250 | 4/1967 | Canada | 336/207 |

*Primary Examiner*—Todd E. DeBoer
*Attorney, Agent, or Firm*—Stanley E. Johnson

[57] ABSTRACT

A low loss composite spider arrangement for use in inductive electrical equipment and an air core reactor incorporating the same in which a non-conductive or a conductive material having very low relative permeability and relatively high resistivity is used to fulfill the mechanical and structural requirements of the spider, and a relatively small amount of electrical conducting material, bonded to and preferably electrically isolated therefrom, is used to fulfill the electrical requirements of the spider.

16 Claims, 2 Drawing Sheets

LOW LOSS SPIDERS

FIELD OF INVENTION

This invention relates to electrical inductive devices having a plurality of coaxially disposed coils electrically connected in parallel, and more particularly to air core current limiting reactors, shunt reactors, VAR reactors, filter reactors, line traps and the like. Hereinafter reference will only be made to current limiting reactors, other forms as noted above being understood.

BACKGROUND OF INVENTION

Current limiting reactors which may be serially or shunt connected in power transmission or distribution systems or the like are, of course, well known in the art and numerous designs have been suggested to reduce as much as possible objectionable losses and heating effects due to eddy currents and the like. Current sharing between the various plural parallel conductors in inductive devices is a problem which, unless solved, results in unequal ac impedance between conductors with the result that most of the current flows through the conductor having the lowest impedance causing excessive heating thereof and possible overload or burnout. Current sharing may be achieved by a technique known as transposition, but transposed conductor inductive devices are difficult to design mechanically and electrically because of their complex geometric configuration and are difficult to manufacture. More recently reactors have been designed which eliminate the need to transpose the conductors, and attention is directed to U.S. Pat. No. 3,264,590 issued Aug. 2, 1966 to Anthony B. Trench, and assigned to the assignee of the present invention, and which describes a reactor utilizing a plurality of helically wound, coaxially disposed coils connected in parallel and having relative lengths and cross-sectional areas such that the induced emf across each coil is substantially equal. The coils connected in parallel are wound concentrically about a common axis. For various reasons it is frequently necessary for the different coils to be terminated at different points around the periphery of the common axis. To connect the coils together in parallel relationship and to the external circuit, a connector in the form of a spider having a plurality of arms extending radially from the common coil axis is provided at each end of the coil structure. The end of each coil is connected to the spider arm to which it is closest by conductors extending parallel with the axis of the coil. The spider is fabricated from aluminum sheet or bar stock material and is designed to perform three main functions, as follows. Firstly, the spiders provide a means of obtaining partial turns in order to force the currents in the various layers and packages forming the reactor to be balanced, as outlined above. For example, if the spiders have eight arms, and it must be emphasized that the number of arms is strictly a matter of design choice, it is possible to wind a layer having a number of turns equal to an integral multiple of one eighth turn. Secondly, the two spider system provides a means of grading the voltage across the coil. All conductors in any selected layer experience the same total voltage across them, but there is a voltage between adjacent conductors of the layer equal to exactly $\frac{1}{n}$ of the voltage per turn (where n is the number of conductors high in the turn in the axial direction). This is because each conductor is terminated on a different spider arm. Assuming that there are N turns in the layer, then the total voltage across the layer is distributed over (nN) conductors instead of N conductors which would be the case if one conductor per layer had been used. Thirdly, all packages of the reactor are rigidly held between the two spiders by means, for example, of resin-impregnated glass fibre ties. The two spiders thus act as main structural members which contribute significantly to the overall strength of the reactor and provide means for lifting and mounting the reactor easily. The structural requirements of the spiders and the electrical, i.e., low loss, requirements are, however, frequently incompatible. The spiders contribute to overall coil losses in two ways (a) the $I^2R$ loss due to the conduction current carried by the spider arms as they carry current to and from the packages, and (b) the eddy losses induced in the spider arms and hubs by the time rate of change of the main magnetic field of the reactor.

Considerable attention is being directed to the production of more efficient electrical inductive equipment and it is therefore of primary concern to reduce losses as much as possible. It has now been determined that one area in which reactor losses may be reduced is in the spider arms themselves.

SUMMARY OF INVENTION

It is therefore one object of the present invention to provide a low loss spider configuration which is particularly useful in air core current limiting reactors and the like, as noted above.

Thus, by one aspect of this invention there is provided a low loss spider arrangement for use in an electrical inductive device having a plurality of coaxially disposed coils connected in parallel, said spider including a hub and a plurality of arms extending radially therefrom, a major portion of said spider being formed from a material having a low relative permeability, a high resistivity and sufficient mechanical strength such that said major portion supports said coils, and a minor portion of said spider being formed of a conducting material of sufficient size to carry an electrical load to and from said coils, and means on said arms to electrically connect said minor portions to said coils.

By another aspect of this invention there is provided an air core reactor comprising a plurality of radially spaced layers of coaxial closely coupled coils; a pair of spiders including arms radiating therefrom, a major portion of said spider being formed from a material having a low relative permeability, a high resistivity and sufficient mechanical strength such that said major portion supports said coils, and a minor portion of said spider being formed of a conducting material of sufficient size to carry an electrical load to and from said coils, said coils being disposed between said spiders with each of said coils being electrically connected selectively to said minor portion of said spiders, ties interconnecting said spiders to provide a rigid reactor unit, and means on said arms for electrically connecting said coils in parallel through said minor portions.

LIST OF DRAWINGS

The invention will be described hereinafter in more detail with reference to the drawings in which.

DESCRIPTION OF PREFERRED EMBODIMENTS

Figure 1:
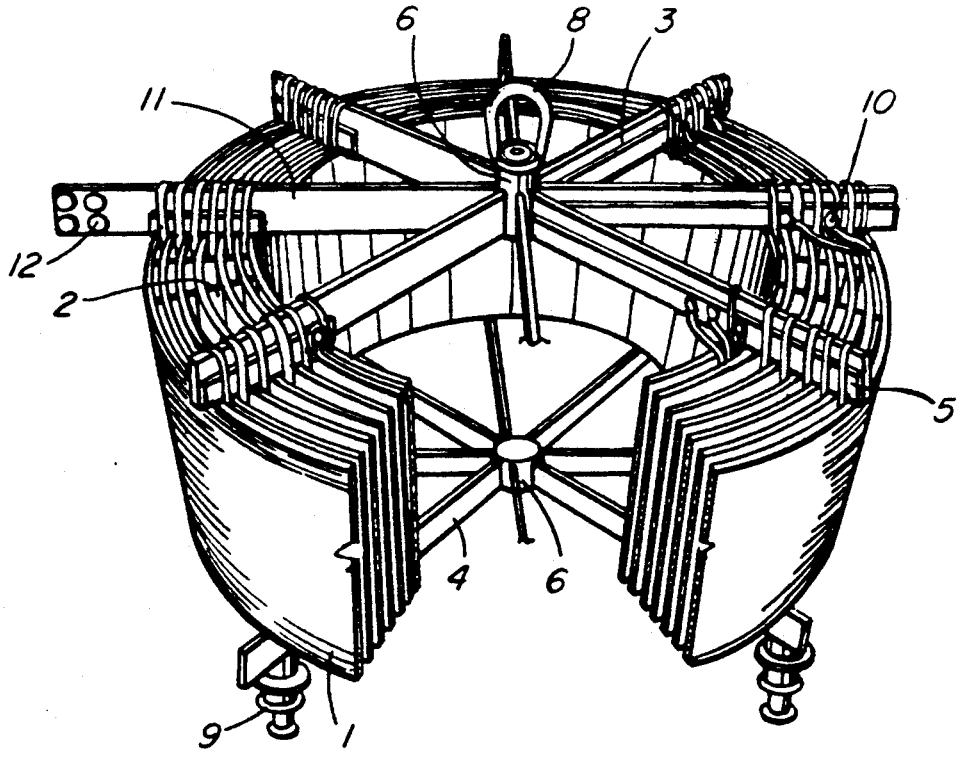
FIG. 1 is an isometric view, partly in section, of an air core current limiting reactor incorporating composite low loss spiders provided in accordance with the present invention.

Referring to the drawings there is illustrated in FIG. 1, a rigid air core reactor unit comprising seven packages 1 of cylindrical coils located between a pair of composite spiders (to be described hereinafter) and wherein the arms of the spiders are interconnected by a plurality of ties 5. The coils 1, generally small diameter, single aluminum conductors wrapped with polyester film insulation although transposed or untransposed cable may also be used in certain applications, are wound about a common axis in seven discrete packages each comprising three parallel layers. It will be appreciated that packages may be either single or multi-layered depending upon specific design requirements. Fiberglass spacers 2 are provided between adjacent packages providing cooling ducts therebetween. Each coil package is encapsulated in a glass roving epoxy encapsulation (75% glass, 25% epoxy resin). The coil packages are thus coaxial and disposed in radial spaced relation each firmly abutting against the arms of respective upper and lower pairs of spiders 3 which are firmly interconnected by means of resin impregnated fiberglass ties 5. The spiders 3, are each provided with eight equally spaced arms 4 extending radially from a hub 6 and fabricated in one of the manners described hereinafter with reference to FIGS. 2 to 5 inclusive or an equivalent thereof. A lifting eye 8 is provided in hub 6 of the top spider for ease of transportation and is removed after installation. The lower spider is provided with a plurality of insulators 9 upon which the reactor stands. The electrical conducting portion of the spider arms may each be provided with a terminal 10 for connecting thereto the conductors of the coil packages 1 at appropriate positions thereon. Alternatively the conductors may be crimped and welded to the electrical conducting portion of the spider arms at the selected positions. The terminal arm 11 of the spider which carries the current to the exterior of the reactor is provided with terminals 12 which are generally but not necessarily tin plated. As noted above, the spiders are required not only to support the weight of the conductors in the coils but also to conduct the current to and from the coils with minimum electrical losses. These requirements are not easy to reconcile as the massive size required for mechanical strength contributes greatly to the production of eddy currents and hence losses in the spiders. In order to reconcile these differences, composite spiders are provided in accordance with the present invention, which separate the structural and electrical functions.

Figure 2:
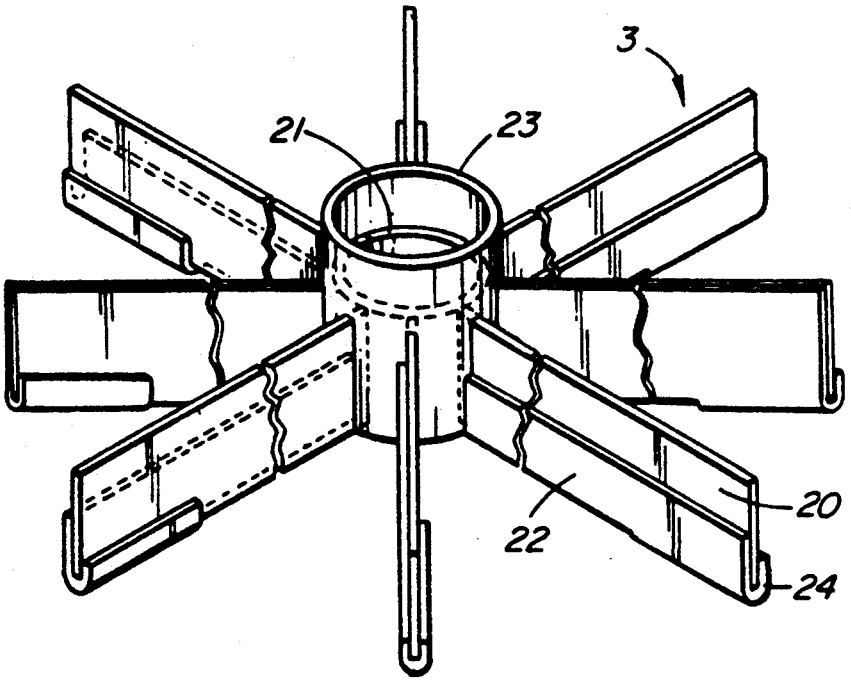
FIG. 2 is an isometric view, partly in section, of a spider according to one embodiment of the present invention.
Figure 3:
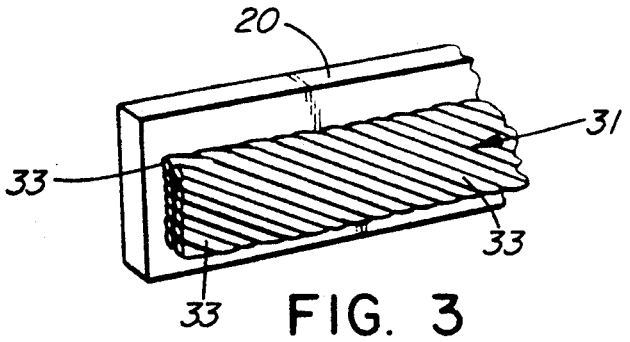
FIG. 3 is an isometric view of a spider arm according to another embodiment of the present invention.

FIG. 2 shows in more detail the composite spider incorporated in the air core reactor shown in FIG. 1. The composite spider 3 comprises a first structural spider having a plurality of arms 20 radially extending from a hub 21 and a second current distributing spider mounted thereon and including a plurality of arms 22 extending radially from a hub 23. The current carrying arms 22 are typically formed from aluminum stock. Hub 23 is generally heat shrunk onto hub 21, and may or may not be electrically isolated therefrom. The spider arms 20 consist of a non-magnetic high resistivity metal such as stainless steel (and typically, but not essentially, 304 austenitic stainless steel) provide a maximum of strength with a minimum of eddy loss. The low eddy loss is due to a combination of material properties (very small relative permeability and relatively high resistivity) and the orientation of the stainless steel spider arms 20 in the magnetic field of the reactor. It is often assumed that a stainless steel conductor will have smaller eddy losses when exposed to a time changing magnetic field than an aluminum conductor of the same shape and size. This is not necessarily true. The orientation of the magnetic field with respect to the conductor has a very important bearing on which conductor will have the greatest eddy loss. However, for the present case, that is of a spider, the arms of which are thin in the azimuthal direction and long in the radial direction, it may be shown that the eddy loss is significantly smaller in the stainless steel than it is in the aluminum. An additional advantage resides in the fact that an additional reduction in losses is achieved over that which is obtained with an aluminum spider of the prior art because the stainless steel spider arms need be only half as thick as the aluminum spider arms to obtain comparable structural properties.

Stainless steel is not very suitable for terminating the windings for two reasons, (I) it is very difficult to make a welded electrical connection between the aluminum or copper conductor of the coil and the stainless steel spider arm, and (II) the large resistivity of the stainless steel introduces large $I^2R$ losses in reactors where the package and line currents are large. To prevent this large $I^2R$ loss, the coil conductors are all terminated on the second aluminum sub-spider arm and not the stainless steel first structural spider. The aluminum sub-spider is used to terminate all windings to obtain the partial turns required for nearly perfect current balance. Since the stainless steel spider arms 20 provide all of the structural strength required, the aluminum spider arms 22 can be chosen to provide sufficient conductance to keep the $I^2R$ losses small and at the same time be made thin enough to keep the eddy losses small as well. The thickness in the aximuthal direction of the spider arms is chosen to ensure that the eddy losses are as small as required (the eddy loss in the spider arm varies as the cube of the thickness in the azimuthal direction and as the first power of the height in the axial direction). The axial height of each spider arm is then chosen to provide sufficient cross-section to keep the $I^2R$ as low as required. The aluminum spider arms 22 have a J-shape portion 24 that curves around one radially extending edge portion of the stainless spider arm 20 not only to present a larger bearing surface between the spider and the coil, but also because the curvature of the aluminum presents a smooth surface to inhibit the production of corona between the spider edge and the end ring or turns of the reactor. The J-shaped portion 24 only extends over the area of the packages and flat strip is used for the inner portion of the conducting sub-spider. The terminal arm of the aluminum conducting sub-spider must have aconsiderably larger cross-section than the other spider arms and consequently has the highest eddy loss of all the components that comprise the composite spider system. However, the loss in this arm may be reduced substantially by constructing the current conducting portion of this arm of continuously transposed sheet conductor 31 (see FIG. 3). Conductor 31 comprises a plurality of sub-conductors 33, each of solid conductor (or plurality of strands) twisted together (i.e., cabled) by means of a calling machine but with the customary center strand omitted to form a hollow helix. The twisted cable is then flattened providing a unilay, continuously transposed sheet conductor.

The structural and conducting sub-spiders are generally, but not essentially, electrically isolated from each other so as to avoid corrosion or galvanic problems between two dissimiliar metals by painting or otherwise coating one or both of the abutting surfaces. In some cases the entire structure may be encapsulated in known manner to prevent ingress of water and other foreign matter which might form, over a period of time, an electrolyte.

Figure 4:
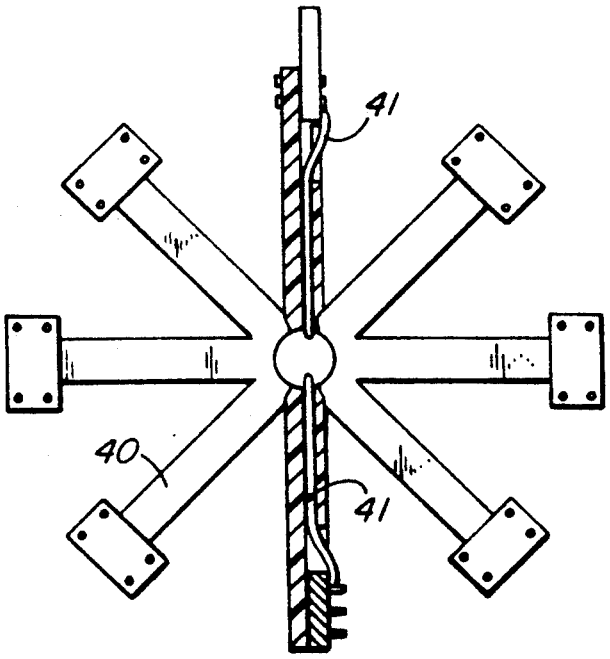
FIG. 4 is a plan view of yet another embodiment of a spider according to the present invention; and, FIG. 5 is an isometric view, partly exploded, of one end of a spider arm of the embodiment shown in FIG. 4.
Figure 5:
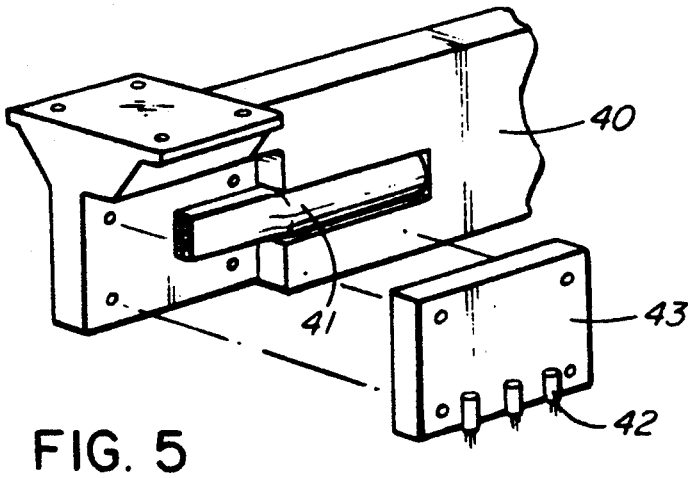

While austenitic stainless steel is probably the strongest material available to form the structural portion of the composite spider, there are design instances where high strength is less important than reduction of electrical losses. In such instances substantially non-conducting structural members may be used. For example, the structural spider may be moulded with composite materials such as polymer resins, fiberglass and fillers. A fibre reinforced plastic composite spider is non-conducting and consequently the only source of loss due to the interaction of the spider with magnetic field of the coils will be the induced eddy losses in the conducting sub-spider. In addition there will be $I^2R$ losses due to the throughput currents, i.e., the line current will flow in the main arm to the hub where it will branch along with the other spokes for distribution to the appropriate winding of the inductor. It is necessary, therefore, to design the sub-spiders for the dual criteria of having sufficient cross-section to carry the rated currents and at the same time have a geometry/construction such that eddy losses are minimized. FIGS. 4 and 5 show one such composite spider which includes a fibre reinforced composite structural spider 40 having a plurality of arms in which are imbedded conducting sub-spider arms 41 generally of aluminum, copper or other suitable conducting material. The conducting sub-spider arm in the terminal arm of the spider is required to have sufficient cross-section to carry the full line current whereas the other sub-spiders only have to carry a portion of the full line current. In order to keep eddy losses to a minimum it may be preferable to employ a special cable such as the transposed cable described with reference to FIG. 3, at least for the terminal arm conducting sub-spider. While FIG. 4 shows the conducting sub-spider imbedded in the structural spider it will be appreciated that this is not essential as merely attaching the conducting sub-spider may well be sufficient. If the sub-spider 41 is embedded, connection to the windings 42 may be effected via an aluminum plate or strip 43 in the portion of the spider located above the winding groups as indicated more clearly in FIG. 5. Plate 43 may be moulded into spider arm 40.

In order to illustrate the advantages of the present invention, two 8.33 MVA 13.8 KV shunt reactors were built and tested. One unit was built with the standard aluminum structural/electrical spider common to the prior art, while the other unit was built as a composite stainless steel structural-aluminum current distributing spider as illustrated in FIG. 2. The standard unit found to have total losses of about 32.4 KW, but while the low loss spider configuration had the same $I^2R$ and conductor eddy losses the reduced spider eddy losses reduced the total losses to 28.4 KW, representing a 12.5% improvement over the standard equipment. In today's market where many high power electrical equipment buyers evaluate losses at levels in the order of $2,000/KW, the advantage of the present invention is significant.

In the foregoing the spiders located respectively at each of opposite ends of the reactor are described as being a composite spider, one portion providing the structural support for the reactor and the other an electrical low loss conducting portion connecting the coils in parallel. While best results are obtained by having the low loss spider at each of opposite ends of the coil, it is obvious some benefits can be gained by having only one of the spiders, a low loss spider provided in accordance with the present invention and the spider at the other end a conventional spider, as for example, the type disclosed in Applicant's aforementioned U.S. Pat. No. 3,264,590. Also, the upper and lower spiders can be somewhat different in structural capabilities from one another, the lowermost requiring the highest structural strength because of being the support for the entire weight of the reactor.

We claim:

1. A low loss spider arrangement for use in an electrical inductive device having a plurality of coaxially disposed radially spaced coils between a pair of such spiders, one being located respectively at each of opposite ends thereof and connecting said coils in parallel, said spider including a plurality of arms extending radially from a central hub with a major portion of said arms being formed from a material having a low relative permeability, a high resistivity and sufficient mechanical strength such that said major portion supports said coils, and a minor portion of said arms being formed of a conducting material of sufficient size to carry an electrical load to and from said coils.

2. A spider arrangement as claimed in claim 1, wherein said major portion is formed from an austenitic stainless steel and said minor portion is aluminum.

3. A spider arrangement as claimed in claim 1, wherein said major portion is formed from a polymeric resin impregnated fibre material and said minor portion comprises a conducting material mounted thereon.

4. A spider arrangement as claimed in claim 3, wherein said conducting material is selected from copper and aluminum.

5. A spider arrangement as claimed in claim 3, wherein said minor portion comprises a continuously transposed cable.

6. A spider arrangement as claimed in claim 1, wherein said major and minor portions of said arms are electrically isolated from each other.

7. A spider arrangement as claimed in claim 1, wherein said major portion arms of said spider are relatively thin in an azimuthal direction and relatively long in a radial direction.

8. An air core reactor comprising a plurality of coaxial radially spaced, closely coupled coils; a pair of spiders located one at each of opposite ends of the coils in abutting relation therewith and interconnected by insulated ties providing a rigid reactor unit, each said spider having arms radiating from a central hub and with a major portion of the arms being formed from a material having a low relative permeability, a high resistivity and sufficient mechanical strength such that said major portion supports said coils, and a minor portion of said arms being formed of a conducting material of sufficient size to carry an electrical load to and from said coils, and electrically connecting the same in parallel.

9. An air core reactor as claimed in claim 8, wherein said major portion of said arms comprises austenitic stainless steel.

10. An air core reactor as claimed in claim 8, wherein said major portion of said arms comprises polymeric resin impregnated fibrous material.

11. An air core reactor as claimed in claim 8, wherein said minor portion comprises aluminum.

12. An air core reactor as claimed in claim 8, wherein said reactor is selected from a current limiting reactor, shunt reactor, VAR reactor, filter reactor and a line trap.

13. An air core reactor as claimed in claim 8, wherein said major and minor portions of said arms are electrically isolated from each other.

14. An air core reactor as claimed in claim 8, wherein said closely coupled coils comprise single aluminum conductors wrapped with polyester film insulation.

15. An air core reactor as claimed in claim 8, wherein said coils comprise cables selected from transposed and untransposed cables.

16. An air core reactor as claimed in claim 8, wherein said arms formed of said major portion are relatively thin in an azimuthal direction and relatively long in a radial direction.

* * * * *